US009999244B2

(12) United States Patent
Green

(10) Patent No.: US 9,999,244 B2
(45) Date of Patent: Jun. 19, 2018

(54) PRE-ROLLED SMOKING PAPER STUFFER

(71) Applicant: Michael Green, Silverthorne, CO (US)

(72) Inventor: Michael Green, Silverthorne, CO (US)

( * ) Notice: Subject to any disclaimer, the term of this patent is extended or adjusted under 35 U.S.C. 154(b) by 40 days.

(21) Appl. No.: 15/149,078

(22) Filed: May 6, 2016

(65) Prior Publication Data

US 2017/0013873 A1 Jan. 19, 2017

Related U.S. Application Data

(60) Provisional application No. 62/192,817, filed on Jul. 15, 2015.

(51) Int. Cl.
*A24F 5/02* (2006.01)
*A24C 5/02* (2006.01)

(52) U.S. Cl.
CPC ..... *A24C 5/02* (2013.01)

(58) Field of Classification Search
CPC ..... A24C 5/02
See application file for complete search history.

(56) References Cited

U.S. PATENT DOCUMENTS 1,724,735 A * 8/1929 Selbach ..... A24C 5/42 131/73
5,292,001 A * 3/1994 Langenbeck ..... B65B 5/068 206/518

OTHER PUBLICATIONS https://www.youtube.com/watch?v=gsKk8VcopuQ (herein referred to as "ConeArtist") published Nov. 14, 2013.*
https://www.youtube.com/watch?v=2qP6gmm-bWY (herein referred to as "Futurola"—published Sep. 15, 2011).*
https://www.youtube.com/watch?v=bizh-ISqwsl (herein referred to as "evidence" published Nov. 6, 2015).*

* cited by examiner

*Primary Examiner* — Kevin R Kruer

(57) ABSTRACT

A Pre-Rolled Smoking Paper Stuffer has a chimney which includes a separator wall bin, converging guide, cradle, tip spacer, and base walls and an extractor base which includes an extractor block, alignment block, and tip pusher. A smoking paper can be inserted into the cradle. Smoking materials are placed into the bin and flow out of the bin and into the converging guide which funnels them into the smoking paper held within the cradle. Once filled, the chimney is pressed onto the base and the alignment block aligns the tip pusher with the smoking-end of the paper. As the chimney continues to be pushed down, the tip pusher displaces the filled smoking paper up and out of the top of the cradle. The stuffed paper can be grasped and lifted out of the stuffer. Multiple stuffers can be attached to one another via the use of various attachment means.

14 Claims, 14 Drawing Sheets

10

PRE-ROLLED SMOKING PAPER STUFFER

CROSS-REFERENCE TO RELATED APPLICATIONS

This application claims the benefit of U.S. Provisional Application No. 62/192,817 entitled PRE-ROLLED SMOKING PAPER STUFFER and filed on Jul. 15, 2015, which is specifically incorporated by reference herein for all that it discloses and teaches.

TECHNICAL FIELD

The present invention relates generally to the field of smoking; more particularly, to the field of creating pre-rolled combinations of smoking materials (usually portions of plants) within rolling papers; and more particularly still, to the field of pre-rolled smoking paper stuffers.

BACKGROUND

Smoking has been recorded in many cultures going back thousands of years. There are many ways to practice smoking, but one of the most common is the cigarette (and its equivalents utilizing non-tobacco smoking materials). Cigarettes are generally cylindrical in shape and comprise a tube of thin paper or similar material surrounding a column of smoking materials such as tobacco, other plants, etc. Many cigarettes are mass-produced each year creating pre-packaged "packs" of cigarettes. However, many people also choose to roll their own cigarettes. In between these two extremes is an industry of custom-rolled cigarettes.

Traditionally, smoking establishments would sell a pre-measured amount of plant/smoking materials to a customer who would then either smoke it using a pipe or other smoking apparatus, or roll it into a cigarette. In more recent times, smoking establishments will still sell a pre-measured amount of materials to a customer, but will then roll it into one or more cigarettes for the customer. Alternatively, the establishment can sell pre-rolled cigarettes, each containing a pre-measured amount of smoking materials. In either of these two cases, a need exists for an easy, quick, and inexpensive means to produce a small batch of pre-rolled cigarettes each containing a pre-measured amount of smoking materials.

Pre-formed conical tubes of rolling paper (i.e., pre-rolled smoking papers) having a slight funnel shape so that they may be nested within one another are available to assist in meeting the above need. Such tubes usually contain a filter or other "end-cap" type device that partially seals the smoking-end (i.e., the smaller-diameter end of the tube) and allows a person to insert smoking materials in the fill-end (i.e., the larger-diameter end of the tube). Once filled, the fill-end can be sealed or otherwise made ready to smoke. Filling such tubes individually is an exacting, time-consuming process. Additionally, because of the relatively small diameter of the fill-end, it can be difficult to ensure that all of the pre-measured smoking materials make it into the tube instead of falling to the sides.

What is needed is a device that holds and supports the pre-rolled smoking paper in an upright configuration and assists the user in funneling the smoking materials into the pre-rolled smoking paper. Such a device should be modular so multiple devices can be used concurrently to further enhance the efficiency of the filling process. The device must provide for individual loading so that a precise amount of smoking materials is ensured in each pre-rolled smoking paper. Additionally, one or more base units should provide for easy removal of the pre-rolled smoking paper(s) from the device once filled.

BRIEF SUMMARY OF THE INVENTION

A Pre-Rolled Smoking Paper Stuffer utilizes a smoking paper chimney comprising a plurality of separator walls, a converging guide, a smoking paper cradle, a smoking paper tip spacer, and a plurality of base walls. The Stuffer also utilizes an extractor base comprising an extractor block, a pusher tip alignment block, and a tip pusher. To use the pre-rolled smoking paper stuffer, a person places the smoking paper chimney upright on a surface. A pre-rolled smoking paper is placed into the smoking paper cradle where it is held in place by friction (the smoking paper cradle is shaped to cradle the pre-rolled smoking paper and hold it securely within the cradle). A pre-determined amount of smoking materials can then be placed into the bin formed by the plurality of separator walls at the top of the chimney. The converging guide at the base of the plurality of separator walls funnels the materials into the pre-rolled smoking paper that is held within the cradle. The materials are dispensed into the bin and funneled automatically by gravity into the converging guide, which guides them into the cradle, and thence into the smoking paper. The device can be shaken or tapped to settle the materials and/or move into position any materials that didn't already move into the smoking paper automatically. The chimney can then be placed onto the extractor base. As the chimney is pushed downwards onto the base, the pusher tip alignment block aligns with the inside of the plurality of base walls, and/or the smoking paper tip spacer, and the tip pusher is then aligned with the smoking-end of the pre-rolled smoking paper. As the chimney is pushed the rest of the way onto the base, the tip pusher exerts an upwards force on the smoking paper and pushes it up and out of the top of the cradle. The person operating the device can then easily grasp the fill-end of the paper and lift the now filled pre-rolled smoking paper out of the stuffer.

The stuffer can utilize a number of additional features to help attach multiple stuffers together so that a plurality of pre-rolled smoking papers can be filled simultaneously. Multiple stuffers can be attached to one another via the use of attachment ports and attachment prongs; base attachment receivers and base attachment clips; and extractor receivers and extractor clips. In other embodiments, other attachments means are contemplated.

DETAILED DESCRIPTION

Figure 1:
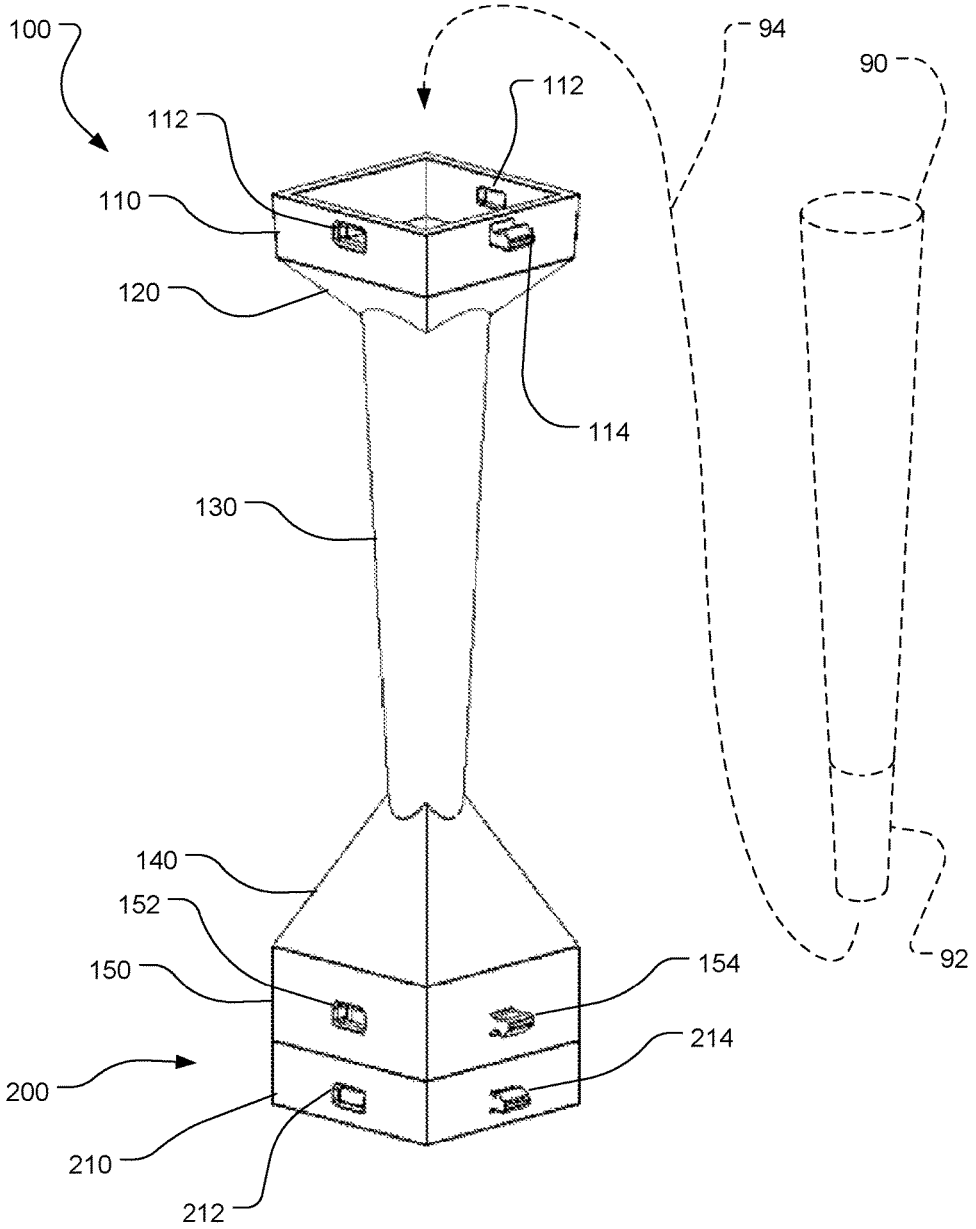
FIG. 1 illustrates a perspective view of an exemplary embodiment of a pre-rolled smoking paper stuffer.

In the following discussion, numerous specific details are set forth to provide a thorough understanding of the present disclosure. However, those skilled in the art will appreciate that embodiments may be practiced without such specific details. Furthermore, lists and/or examples may be provided and should be interpreted as exemplary only and in no way limiting embodiments to only those lists/examples.

Exemplary embodiments are described below in the accompanying Figures. The following detailed description provides a review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a perspective view of an exemplary embodiment of a pre-rolled smoking paper stuffer 10. A pre-rolled smoking paper stuffer 10 comprises a smoking paper chimney 100 and an extractor base 200.

The smoking paper chimney 100 comprises a separator wall bin 110, a converging guide 120, a smoking paper cradle 130, a smoking paper tip spacer 140, and a plurality of base walls 150. The Stuffer also utilizes an extractor base 200 comprising an extractor block 210, a pusher tip alignment block 220 (not shown in FIG. 1, see FIG. 2, item 220C and FIG. 12, item 220), and a tip pusher 230 (also not shown in FIG. 1, see FIG. 2, item 230C and FIG. 12, item 230).

At the top of the smoking paper chimney 100 is a plurality of separator walls that together define the separator wall bin 110. In the embodiment illustrated in FIG. 1, the number of separator walls is four and together they form a square. In other embodiments, the number of separator walls can be three, four, or more. Additionally, although the exterior perimeter of the separator walls should be polygonal in shape so that multiple stuffers 10 can be easily attached to one another while minimizing any gapping therebetween, the interior of the separator wall bin 110 can be circular, polygonal, etc. in alternate embodiments. The separator wall bin 110 allows a relatively large amount of smoking materials to be placed therein all at once without worrying about spilling the materials either out of the stuffer 10 altogether, or into adjacent stuffers when configured in multi-stuffer modules (see, for example, a three-by-one module in FIG. 2 and the three-by-three module in FIG. 9).

The bin 110 accepts the smoking materials therein and immediately and automatically begins to feed materials downwards into the converging guide 120. Gravity causes the materials to move automatically, but if any bridging or friction occurs and materials get hung-up, a simple shake or tap will assist the flow of materials.

The stuffer 10 can also be shaken and/or tapped/vibrated to move the materials downwards and settle them further into the chimney 100 (and hence into the pre-rolled smoking paper 90 if one has been inserted as shown in FIG. 1 prior to adding smoking materials to the stuffer 10).

Multiple stuffers can be attached to one another via the use of attachment means which can be a plurality of attachment ports 112 and a plurality of attachment prongs 114 in/on the separator wall bin 110, as illustrated in the embodiment shown in FIG. 1. In other embodiments, other types of attachment means are contemplated, including attachment means mounted on the converging guide 120 or even on the smoking paper cradle 130. Although it is preferable for the separator wall bins 110 of neighboring stuffers to be contiguous and support one another (see FIG. 9 for an example of a three-by-three module), it is not strictly necessary for them to do so. However, any gap(s) between the wall bins may allow smoking materials to fall between them during filling rather than into the bins as desired.

At the base of the separator wall bin 110 is a converging guide 120. The converging guide 120 is formed with sloping sidewalls that funnel the smoking materials into the opening at the top of the smoking paper cradle 130 automatically due to gravity. Again, a small amount of tapping or shaking may assist any recalcitrant materials in entering the smoking paper cradle 130.

The smoking paper cradle 130, accepts the smoking materials from the converging guide 120 and directs them down into the pre-rolled smoking paper 90 that can be securely held within the cradle 130. As the cradle 130 has an interior that is shaped to match the exterior of a pre-rolled smoking paper, there is little if any gap between the two and smoking materials that enter the top of the cradle 130 are directed cleanly and efficiently into the pre-rolled smoking paper 90. A person operating the stuffer can shake/vibrate/tap the stuffer 10 to facilitate movement of the smoking materials through the bin 110, guide 120, and cradle 130 and into the pre-rolled smoking paper 90. Additionally, a packing tool can be used to compress the smoking materials into the smoking paper if needed.

In one embodiment, the smoking paper cradle 130 is generally conical in interior shape so as to approximately match the conical exterior shape of the pre-rolled smoking paper 90 (both are basically inverted cones in shape). The exterior of the cradle 130 can be almost any shape. In another embodiment, the interior of the cradle 130 is shaped as an inverted cone, but with the base shape being a polygon such as a triangle, rectangle, pentagon, etc. so that the inverted cone is generally pyramidal in shape, having three, four, five, six, or more sides. Although it is preferable that such an embodiment have sides of approximately equal dimensions, it is not a requirement. In yet another embodiment, the interior of the cradle 130 has a cross-section that is approximately oval, elliptical, or some other curved shape. Throughout this document, any reference to an inverted cone or inverted conical shape shall include all of those shapes discussed in this paragraph, as the mathematical definition of a cone allows a base of any shape. Note that the apex of the cone does not lie within the cradle but is below the bottom of the cradle 130.

Depending on the size and configuration of the pre-rolled smoking paper 90, a smoking-end portion of the paper 90, called a smoking paper tip 92, may extend downwards out of the bottom of the smoking paper cradle 130 varying distances. In a common embodiment, short or long (also described as small or large) pre-rolled smoking papers 90 extend out of the bottom of the smoking paper cradle 130. In the embodiment in FIG. 1, a smoking paper tip spacer 140 extends downwards and outwards from the bottom of the cradle 130 and helps to ensure that the smoking paper tip 92 does not contact the surface upon which the chimney 100 is resting during filling. Also, the outwards flaring of the smoking paper tip spacer 140 helps to ensure that the chimney 100 has a wide, secure base on which to stand so that it does not tip over easily. However, other embodiments of the stuffer 10 may have no flaring, lesser flaring, or greater flaring without departing from the scope of the invention. In yet another embodiment, the smoking paper tip spacer attaches to at least one of the smoking paper cradle, the converging guide, and the separator wall bin. Although somewhat inefficient in theory, attaching the spacer 140 to other portions of the stuffer besides the cradle may allow a person to see and access the smoking paper tip. In another embodiment, the material(s) of which the components are constructed can be translucent or transparent so a person using the stuffer can see the smoking paper tip.

In the embodiment illustrated in FIG. 1, a plurality of base walls 150 is attached to the bottom of the smoking paper tip spacer 140. In other embodiments, the base walls 150 are otherwise attached to the stuffer. The base walls 150 can provide a strong, supportive base to ensure that the stuffer 10 remains upright during filling. The base walls 150 can also extend downward below the cradle 130 and help to further ensure that even particularly long/large smoking papers and/or smoking paper tips 92 do not contact the surface upon which the chimney 100 is resting during filling. Additionally, the base walls 150 provide a guide within which the extractor base 200 can be inserted. The base walls 150 receive the extractor base and align the base with the bottom opening of the cradle so that a portion of the base (the tip pusher, see FIGS. 2, 12, 14A and 14B) can contact the bottom of any pre-rolled smoking paper in the stuffer. Then, as the extractor base is fully received by the base walls, the tip pusher displaces the smoking paper upwards enough so that a person can grasp a top of the smoking paper protruding from the top of the cradle.

The base walls 150 can also incorporate a plurality of base attachment means 152 and 154. In the embodiment illustrated in FIG. 1, the base attachment means can include a plurality of base attachment receivers 152 and a plurality of base attachment clips 154. The clips 154 on a first stuffer 10 can be adapted to fit within the receivers 152 on other stuffers, thereby forming modules of stuffers (see FIGS. 2-9 for examples).

In the embodiment illustrated in FIG. 1, the number of base walls 150 is four and together they form a square. In other embodiments, the number of base walls can be three, four, or more. Additionally, the exterior perimeter of the base walls should be generally polygonal in shape so that multiple stuffers 10 can be easily attached to one another. However, in alternate embodiments, other shapes are contemplated including those that facilitate easy attachment and those that don't. For example, attachment means could be mounted on the smoking paper tip spacer 140 and so the external shape of the base walls 150 would be less relevant as they would not even need to touch the nearby base walls of other stuffers.

Figure 2:
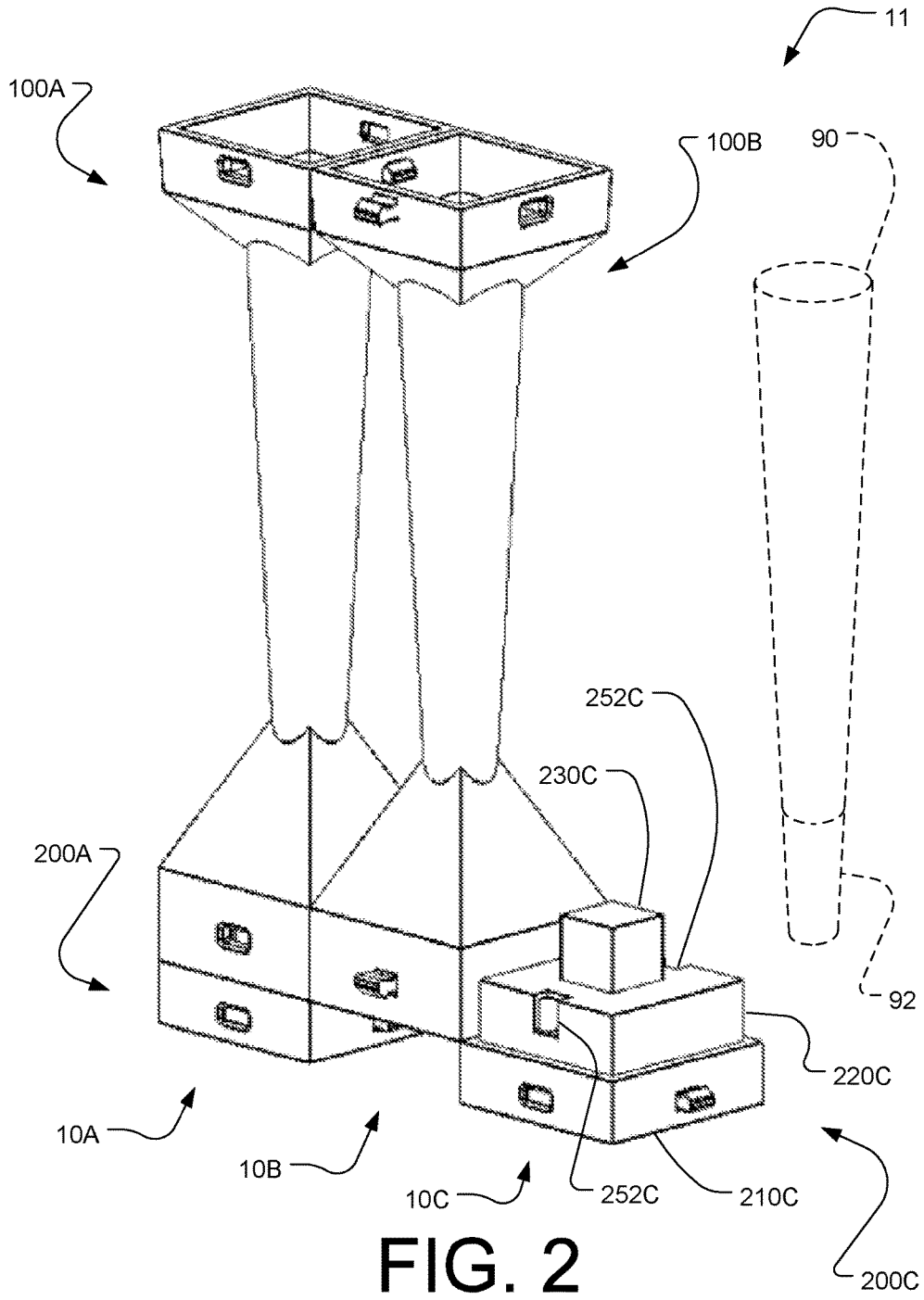
FIG. 2 illustrates a perspective view of an exemplary embodiment of a three-by-one module of a plurality of pre-rolled smoking paper stuffers.
Figure 12:
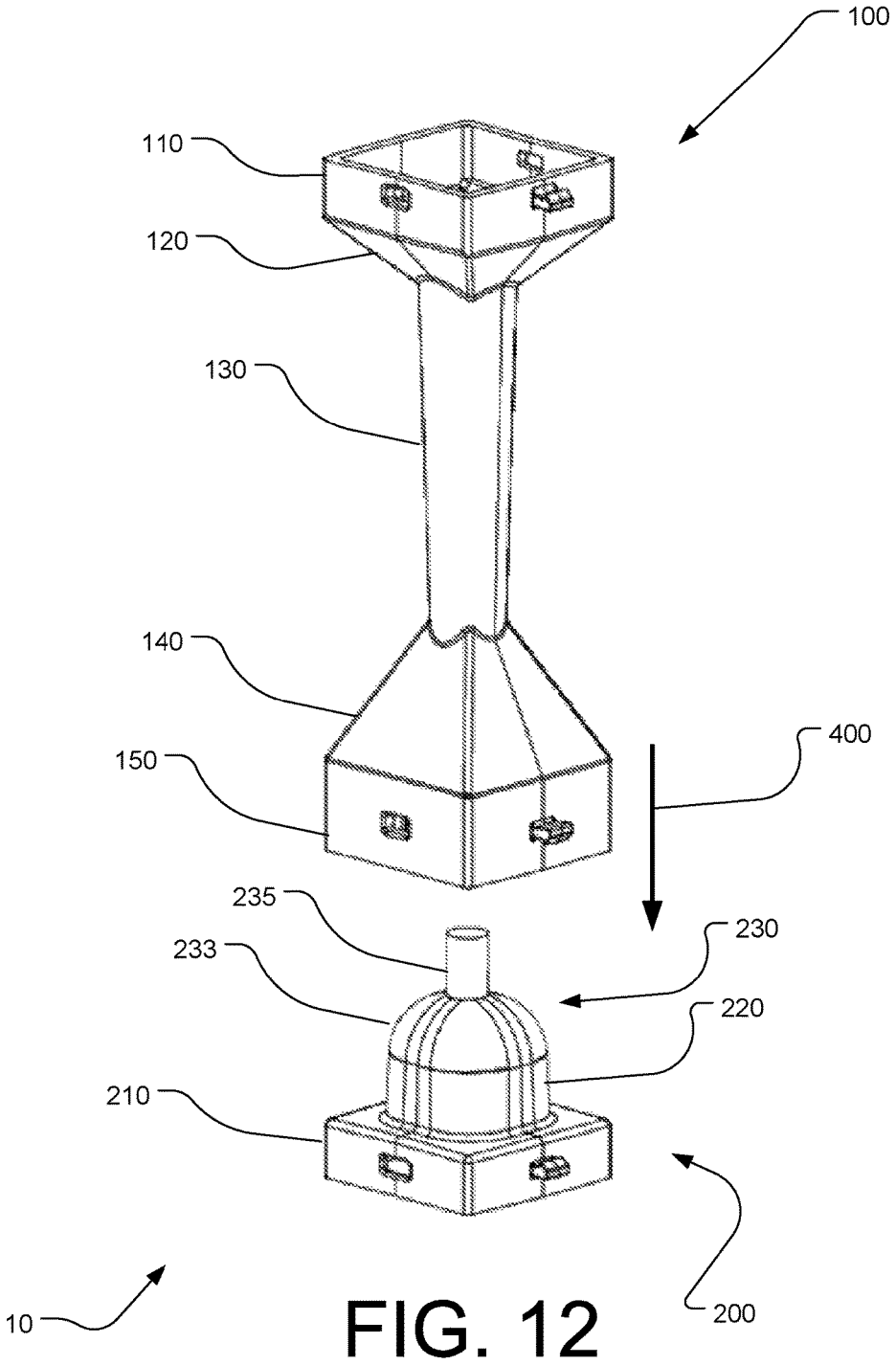
FIG. 12 illustrates a perspective view of an exemplary embodiment of a pre-rolled smoking paper stuffer with a smoking paper chimney portion being lowered downwards onto another alternate embodiment of an extractor base portion.

The stuffer 10 also utilizes an extractor base 200 comprising an extractor block 210, a pusher tip alignment block 220 (not shown in FIG. 1, see FIG. 2, item 220C and FIG. 12, item 220), and a tip pusher 230 (also not shown in FIG. 1, see FIG. 2, item 230C and FIG. 12, item 230).

The extractor block 210 forms the bottom of the extractor base 200 and should provide a level surface upon which the stuffer can stand upright. In the embodiment illustrated in FIG. 1, the extractor block 210 is illustrated as having four block walls that together form a square. In other embodiments, the number of block walls can be three, four, or more. Additionally, the exterior perimeter of the block walls may be polygonal in shape to help facilitate the connection of multiple extractor blocks 210 to one another via a plurality of extractor block attachment means 212 and 214 (illustrated in the embodiment shown in FIG. 1 as a plurality of extractor receivers 212 and a plurality of extractor clips 214). Multi-stuffer modules support multiple stuffers together as one unit, see FIG. 9 for an example.

In other embodiments, other shapes for the extractor blocks 210 are contemplated including those that facilitate easy attachment and those that don't. For example, if the plurality of extractor block attachment means 212 and 214 sufficiently and strongly connected neighboring extractor blocks together, then the walls of extractor blocks 210 would not need to touch one another in multi-stuffer modules and could therefore be almost any shape. In yet another embodiment, block attachment means 212 and 214 could comprise connectors to a base plate or similar, such that all extractor blocks attach to the base plate rather than to each other.

For more detail concerning the other components of the extractor base 200, see later descriptions in FIGS. 2, 12, 13, 14A and 14B.

The stuffer can utilize a number of additional features to help attach multiple stuffers together so that a plurality of pre-rolled smoking papers can be filled simultaneously. Multiple stuffers can be attached to one another via the use of various attachment means, including, but not limited to: attachment ports 112 and attachment prongs 114; base attachment receivers 152 and base attachment clips 154; and extractor receivers 212 and extractor clips 214. In other embodiments, other attachments means are contemplated including hook and loop materials, adhesives, magnets, snaps, plates, snap-locks, dovetails, ultrasonic welding, or any other suitable types of connectors. In some embodiments, permanently connected multi-stuffer modules are contemplated.

While FIG. 1 illustrates three sets of attachment means: attachment ports 112 and attachment prongs 114; base attachment receivers 152 and base attachment clips 154; and extractor receivers 212 and extractor clips 214; the actual number of attachment means may vary. Although it is preferable for multiple stuffers to attach to one another at the top of the chimney, bottom of the chimney, and at the extractor block, it is contemplated in other embodiments that such number and location of attachment means can vary.

To use the pre-rolled smoking paper stuffer 10, a person places the smoking paper chimney 100 upright on a surface. A pre-rolled smoking paper 90 is placed into the smoking paper cradle 130 where it is held in place by friction (the smoking paper cradle 130 is shaped to cradle the pre-rolled smoking paper 90 and hold it securely within the cradle 130). A pre-determined amount of smoking materials can then be placed into the bin 110 formed by the plurality of separator walls at the top of the chimney 100. The converging guide 120 at the base of the bin 110 automatically funnels the materials into the pre-rolled smoking paper 90 within the cradle 130. Once all the materials have been dispensed into the chimney 100, the device can be shaken or tapped to settle the materials. The chimney 100 can then be placed onto the extractor base 200. As the chimney 100 is pushed downwards onto the base 200, the pusher tip alignment block 220 aligns with the inside of the plurality of base walls 150 (and/or the spacer) and the tip pusher 230 is then aligned with the pre-rolled smoking paper tip 92 at the smoking-end of the pre-rolled smoking paper 90. As the chimney 100 is pushed the rest of the way onto the base 200, the tip pusher 230 exerts an upwards force on the smoking paper 90 and pushes it up and out of the top of the cradle 130. The person operating the stuffer 10 can then easily grasp the fill-end of the paper and lift the now filled pre-rolled smoking paper out of the stuffer 10.

A sample pre-rolled smoking paper 90 is shown in FIG. 1 as able to be placed in the stuffer 10 (see placement arrow 94 directing the pre-rolled smoking paper tip 92 into the open top of the chimney 100). However, since the chimney 100 is fully mounted on the extractor base 200 in FIG. 1, the top of the smoking paper cone 90 would stick up above the smoking paper cradle 130 and into either the separator wall bin 110 or the converging guide 120. Instead, the paper 90 should be placed in the chimney 100 while the chimney is not engaged with the extractor base 200. Once the paper 90 is filled, then the chimney 100 can be placed on the extractor base 200, thereby pushing the paper 90 up and partially out of the cradle 130 so that the person filling the paper 90 can easily grasp the top of it and remove it from the stuffer 10.

FIG. 2 illustrates a perspective view of an exemplary embodiment of a three-by-one module 11 of a plurality of pre-rolled smoking paper stuffers 10A, 10B, and 10C. The first stuffer 10A is shown with all components: chimney 100A and extractor base 200A. The second stuffer 10B is shown with only the chimney 100B and no extractor base. The third stuffer 10C is shown only with the extractor base 200C and no chimney. A pre-rolled smoking paper 90 is shown in broken lines to illustrate appropriate orientation to the stuffer 10, although the paper 90 is offset a distance to the right so that the module 11 is depicted clearly.

FIG. 2 also illustrates more details of an exemplary embodiment of an extractor base 200C. In this embodiment, the third stuffer 10C utilizes an extractor base 200C comprising an extractor block 210C, a pusher tip alignment block 220C, and a tip pusher 230C. The pusher tip alignment block 220C extends upwards from the extractor block 210C so that it can be inserted within the plurality of base walls 150 (not referenced in FIG. 2, see FIG. 1) on the associated chimney of the stuffer 10C. As the pusher tip alignment block 220C aligns itself with the base walls 150, this ensures that the tip pusher 230C is centered and can contact any pre-rolled smoking paper tip 92 that extends out of the bottom of the cradle. As the extractor base 200C becomes fully mounted onto the bottom of the chimney, the tip pusher 230 will push the pre-rolled smoking paper 90 slightly up and out of the top of the cradle so that a person can grasp the paper and remove it from the stuffer.

A plurality of base support clip spacers 252C is illustrated in FIG. 2. For the type of attachment means illustrated in FIG. 2, clip spacers 252C are needed in order to ensure the plurality of base attachment clips 154 (see FIG. 1) do not impact the alignment block 220C when inserting into the neighboring base attachment receivers 152 when connecting multiple stuffers 10 to one another.

Figure 3:
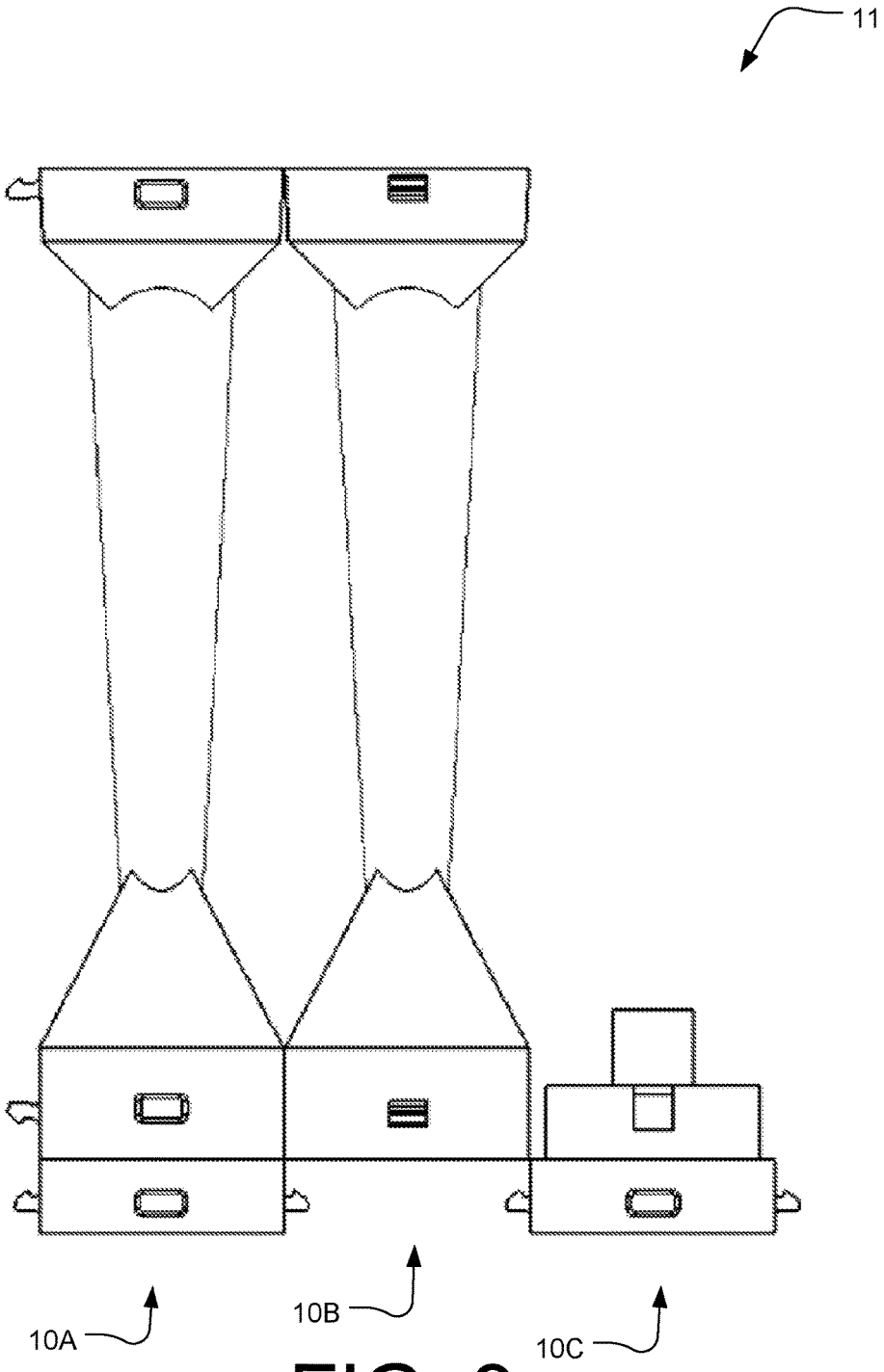
FIG. 3 illustrates a front elevation view of an exemplary embodiment of a three-by-one module of a plurality of pre-rolled smoking paper stuffers.

FIG. 3 illustrates a front elevation view of an exemplary embodiment of a three-by-one module 11 of a plurality of pre-rolled smoking paper stuffers 10A, 10B, and 10C. Note how the stuffers are attached to one another utilizing the various attachment means illustrated in FIGS. 1-9.

Figure 4:
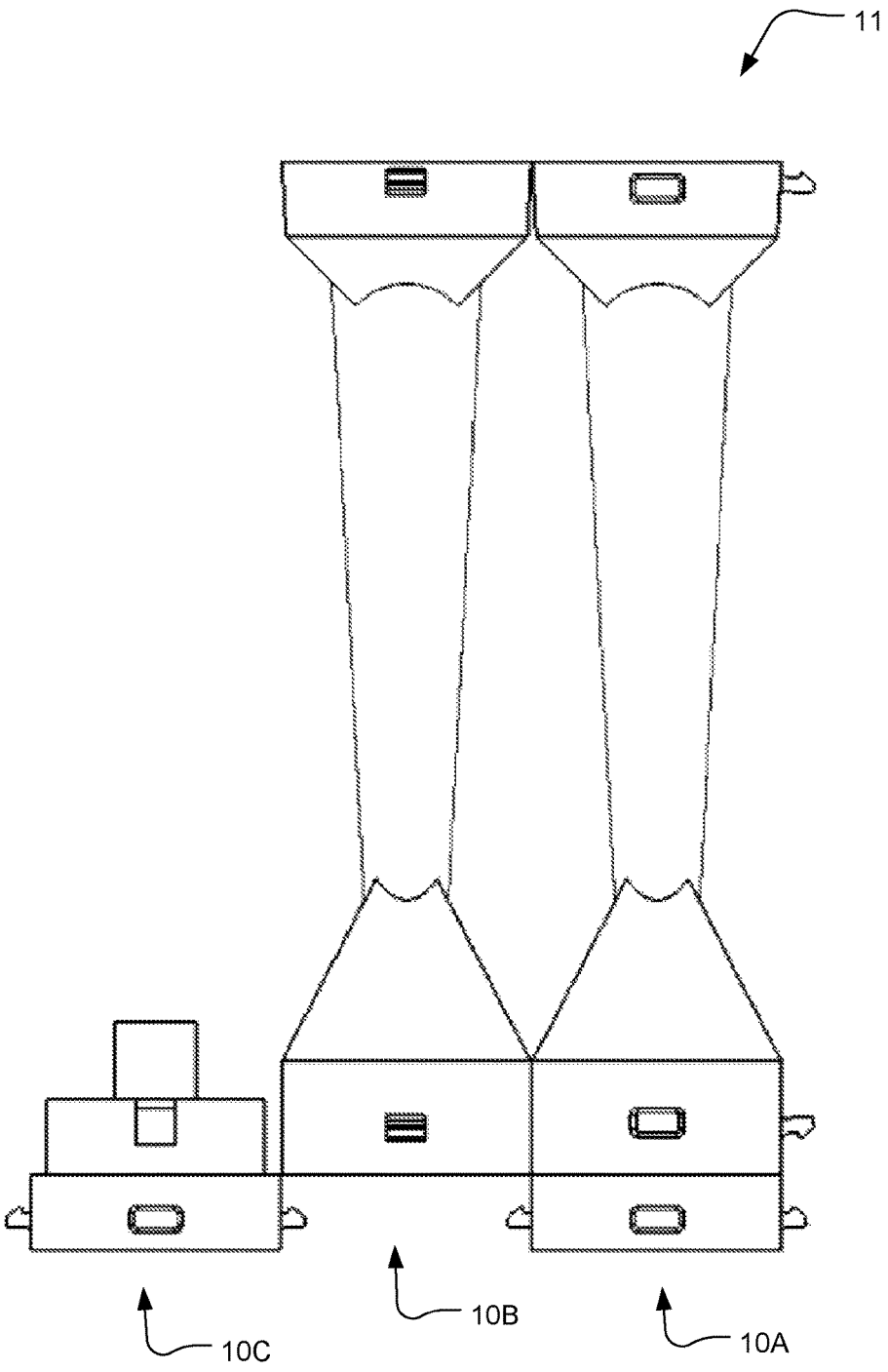
FIG. 4 illustrates a rear elevation view of an exemplary embodiment of a three-by-one module of a plurality of pre-rolled smoking paper stuffers.

FIG. 4 illustrates a rear elevation view of an exemplary embodiment of a three-by-one module 11 of a plurality of pre-rolled smoking paper stuffers 10A, 10B, and 10C. Note how the tops of the chimneys of 10A and 10B abut in this embodiment.

Figure 5:
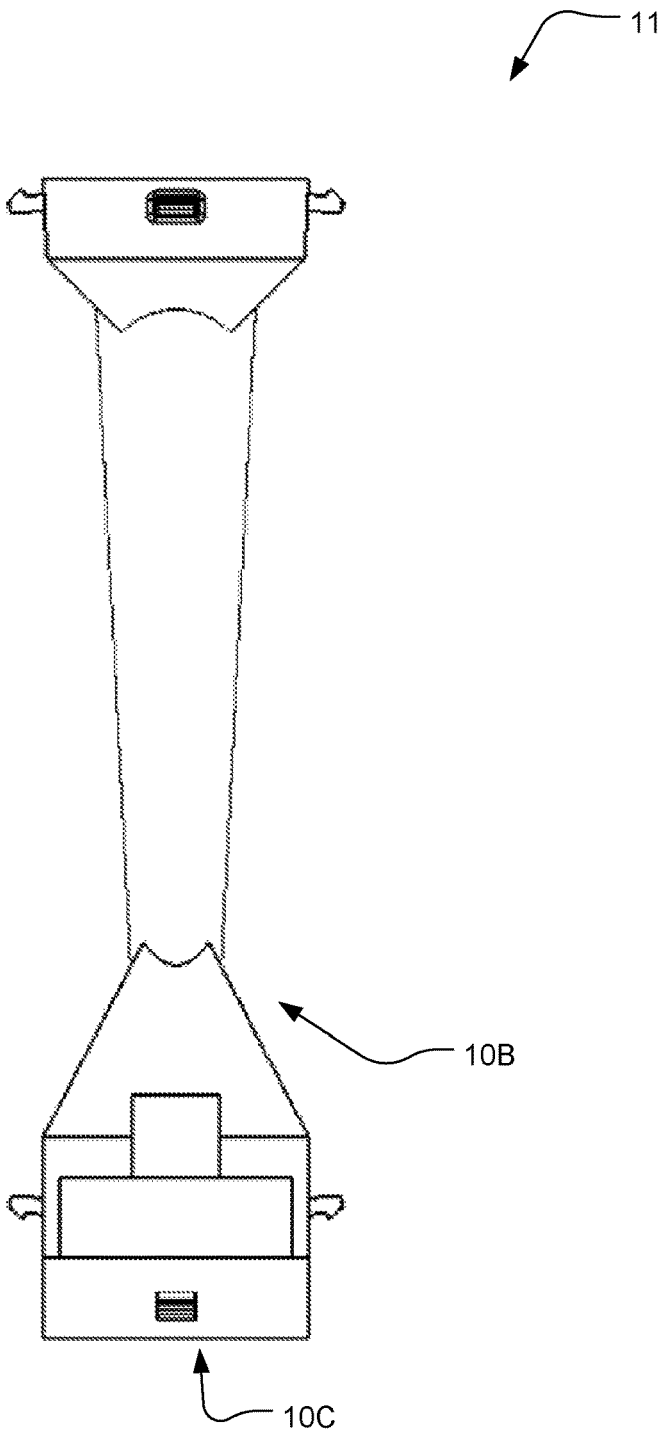
FIG. 5 illustrates a right side elevation view of an exemplary embodiment of a three-by-one module of a plurality of pre-rolled smoking paper stuffers.

FIG. 5 illustrates a right side elevation view of an exemplary embodiment of a three-by-one module 11 of a plurality of pre-rolled smoking paper stuffers 10B and 10C (10A is not visible in this view).

Figure 6:
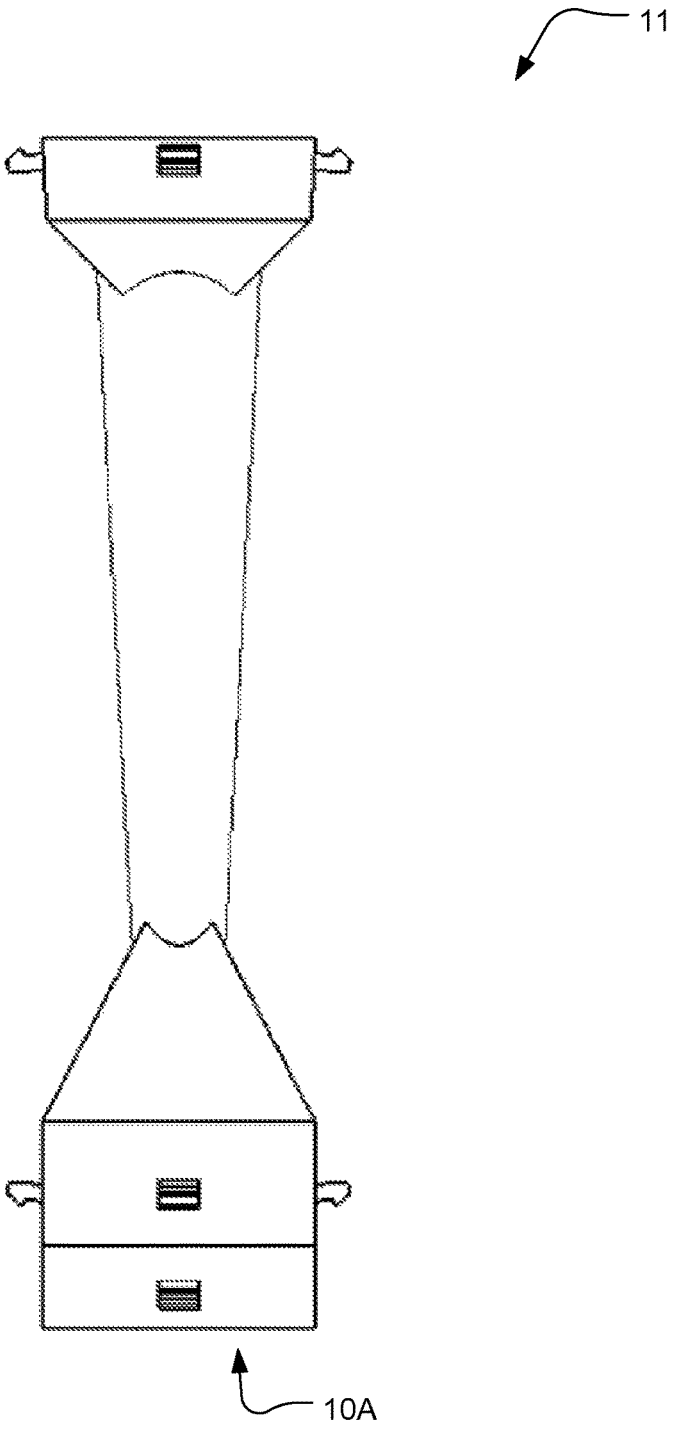
FIG. 6 illustrates a left side elevation view of an exemplary embodiment of a three-by-one module of a plurality of pre-rolled smoking paper stuffers.

FIG. 6 illustrates a left side elevation view of an exemplary embodiment of a three-by-one module 11 of a plurality of pre-rolled smoking paper stuffers 10A (10B and 10C are not visible in this view).

Figure 7:
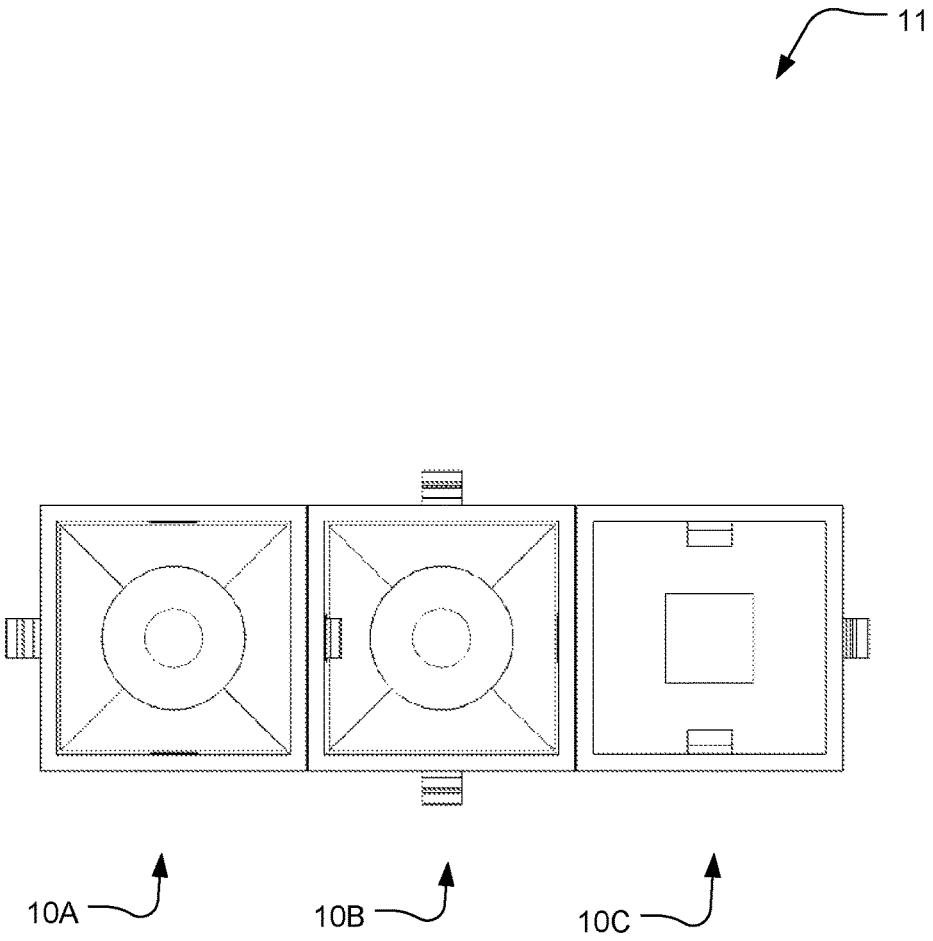
FIG. 7 illustrates a top plan view of an exemplary embodiment of a three-by-one module of a plurality of pre-rolled smoking paper stuffers.

FIG. 7 illustrates a top plan view of an exemplary embodiment of a three-by-one module 11 of a plurality of pre-rolled smoking paper stuffers 10A, 10B, and 10C. Note that as in FIGS. 2-8, this view does not include a chimney for stuffer 10C. Thus, the converging guides of 10A and 10B are visible, but only the top of the extractor block of 10C can be seen.

Figure 8:
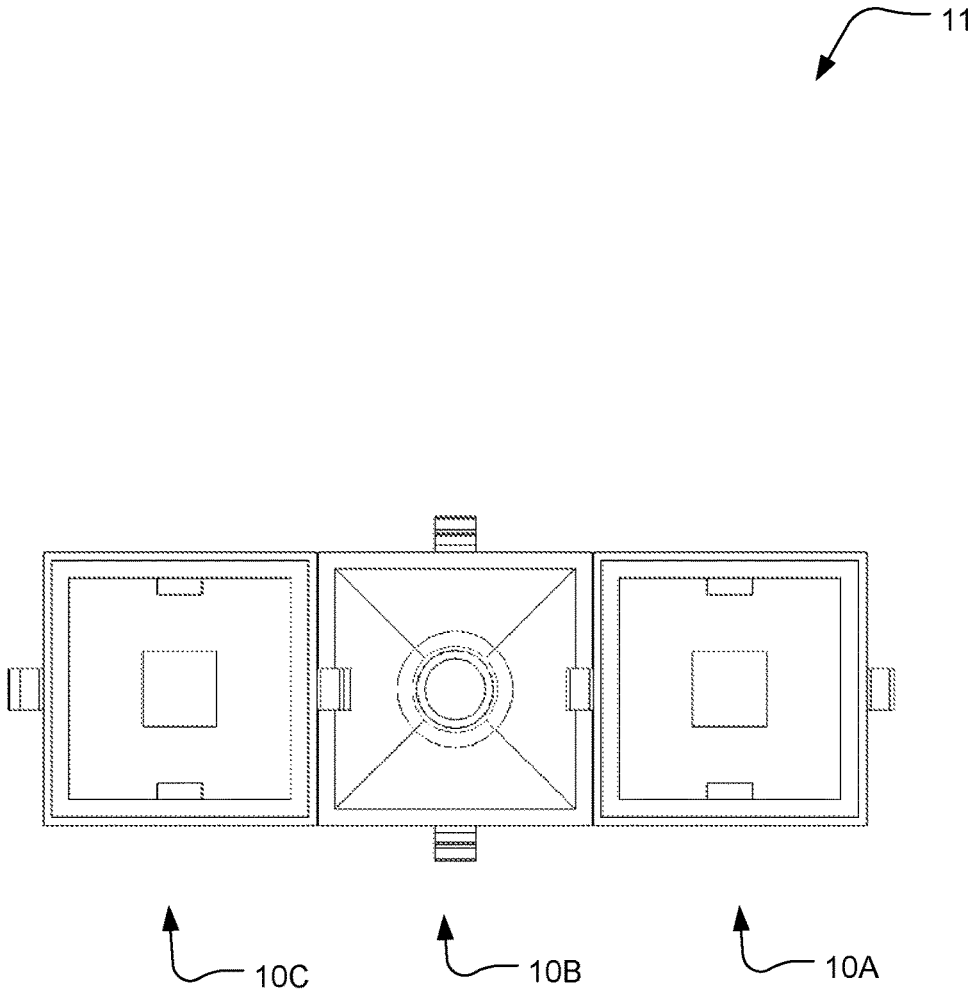
FIG. 8 illustrates a bottom plan view of an exemplary embodiment of a three-by-one module of a plurality of pre-rolled smoking paper stuffers.

FIG. 8 illustrates a bottom plan view of an exemplary embodiment of a three-by-one module 11 of a plurality of pre-rolled smoking paper stuffers 10A, 10B, and 10C. Note that as in FIGS. 2-7, this view does not include an extractor block for stuffer 10B. Thus, the bottoms of the extractor blocks of 10A and 10C are visible, and the bottom of the chimney of 10B can be seen as well.

Figure 9:
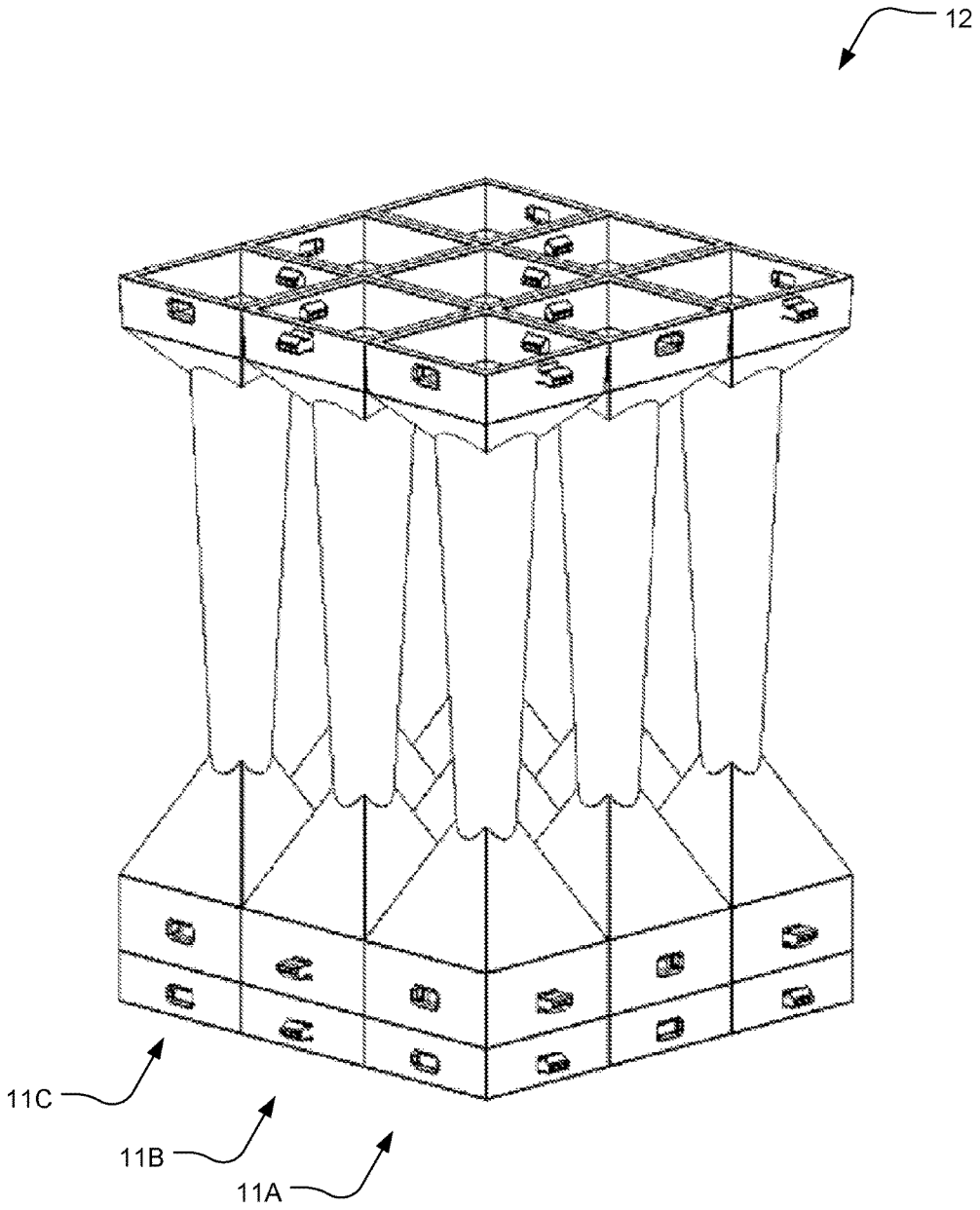
FIG. 9 illustrates a perspective view of an exemplary embodiment of a three-by-three module of a plurality of pre-rolled smoking paper stuffers.

FIG. 9 illustrates a perspective view of an exemplary embodiment of a three-by-three module 12 of a plurality of pre-rolled smoking paper stuffers. Note that a three-by-three module 12 can comprise nine individual stuffers or it can comprise three three-by-one modules 11A, 11B, and 11C as illustrated in FIG. 9.

Figure 10:
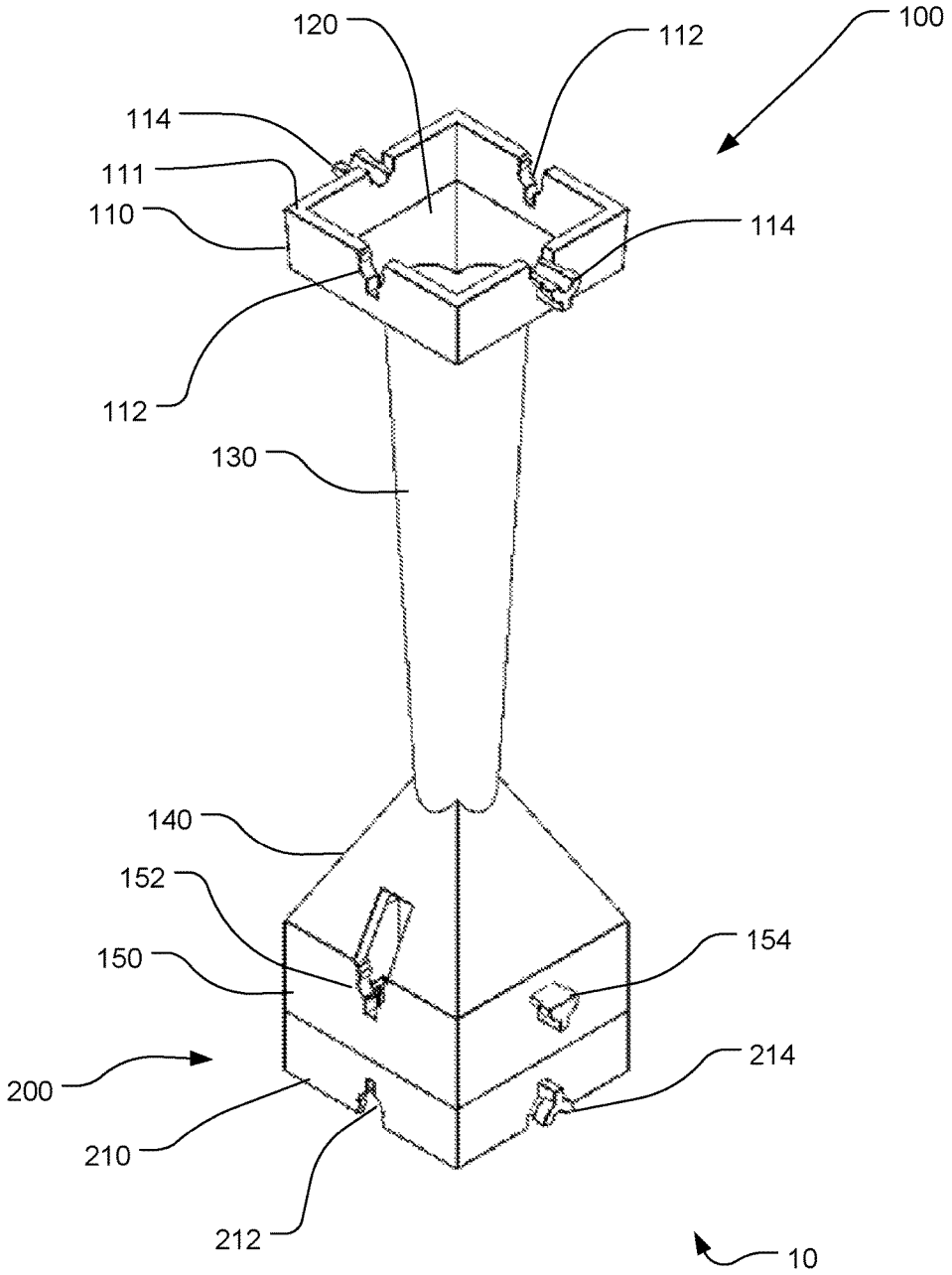
FIG. 10 illustrates a perspective view of an exemplary embodiment of a pre-rolled smoking paper stuffer highlighting a possible alternate attachment means.

FIG. 10 illustrates a perspective view of an exemplary embodiment of a pre-rolled smoking paper stuffer 10 highlighting a possible alternate attachment means. Instead of the spring clips/prongs and appropriately shaped receivers/ports of the various attachment means illustrated in FIGS. 1-9, FIGS. 10 and 11 illustrate a series of Y shaped prongs/clips and appropriate receivers/ports as an alternate attachment means.

Figure 11:
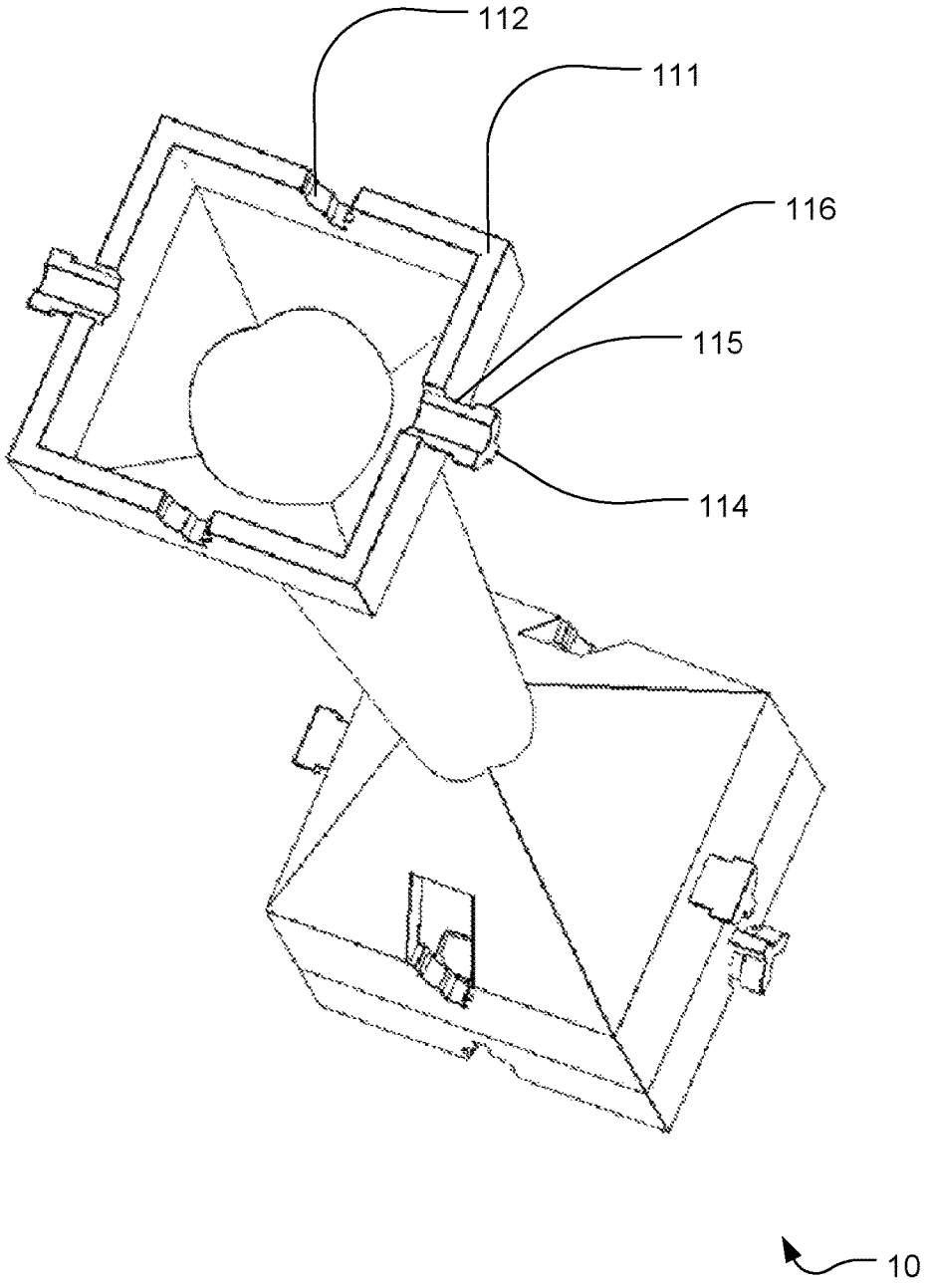
FIG. 11 illustrates another perspective view of an exemplary embodiment of a pre-rolled smoking paper stuffer highlighting a possible alternate attachment means.

FIG. 11 illustrates another perspective view of an exemplary embodiment of a pre-rolled smoking paper stuffer 10 highlighting a possible alternate attachment means. The separator wall bin 110 is illustrated in FIG. 11 from a top perspective view allowing the separator walls' top rims 111 to be shown. The thickness of the top rims 111 can be seen. When an attachment prong 114 from a neighboring stuffer 10 is connected to an attachment port 112, the prong knob 115 must extend completely over the neighbor's top rim to engage the backsides of the attachment port 112. For this to occur, the prong cut-back 116 must be cut back from the prong knob 115 so that it can rest inside the attachment port 112. These features are used in this particular type of attachment means as illustrated in FIG. 11. In the attachment means illustrated in FIGS. 1-9, a clip/prong 154/214/114 can be used instead, although the attachment action is similar, the components are slightly differently shaped. Either type of attachment means may be used, as may other different types in other embodiments.

FIG. 12 illustrates a perspective view of an exemplary embodiment of a pre-rolled smoking paper stuffer 10 with a smoking paper chimney portion 100 being lowered downwards onto another alternate embodiment of an extractor base portion 200. In this embodiment, the downwards direction arrow 400 shows that the chimney 100 is placed downwards onto the extractor base 200. A number of the components of the extractor base 200 are somewhat different in this embodiment compared to those shown in the previous FIGS. For example, the pusher tip alignment block 220 illustrated in FIG. 12 is curved while other embodiments show a polygonal alignment block 220. Note that since the alignment block 220 in FIG. 12 is spaced back from the edge of the extractor block 210, no plurality of base support clip spacers 252C (see FIG. 2) are needed in the embodiment illustrated in FIG. 12.

The tip pusher 230 illustrated in FIG. 12 can be curved and can comprise a long smoking paper tip pusher knob 233 and a short smoking paper tip pusher extension 235. In other embodiments, the tip pusher 230 may not incorporate a short smoking paper tip pusher extension 235 (see FIG. 14A for an example). This extra tip pusher extension 235 allows the use of short smoking papers that would otherwise not be pushed up by the long smoking paper tip pusher knob 233. Although both short and long smoking papers can have tips that extend approximately the same distance out of the bottom of the chimney, they have different overall lengths. Thus, the long smoking paper tip pusher knob 233 could act on either short or long papers, but only long papers are long enough to extend above the top of the cradle when pushed by the long smoking paper tip pusher knob 233. Short smoking papers would be pushed upwards by the pusher knob 233, but possibly not far enough to extend beyond the top of the cradle 130, so a person would not be able to grab the top of the short smoking paper and remove it from the stuffer 10. In such a case, a tip pusher 230 having a tip pusher extension 235 can be utilized to push the top of the short smoking paper further up and actually partially out of the top of the cradle so a person can grasp it and remove it completely from the stuffer. The tip pusher extension 235 can also be used with long smoking papers, with the result that the top of the smoking paper is pushed further out of the top of the cradle than without the tip pusher extension 235. Additionally, the extension 235 can be of various lengths in various embodiments so that it extends differing amounts into the cradle 130 (or alternately varying amounts into the spacer 140) when the extractor base 200 is properly seated on the chimney 100.

Figure 13:
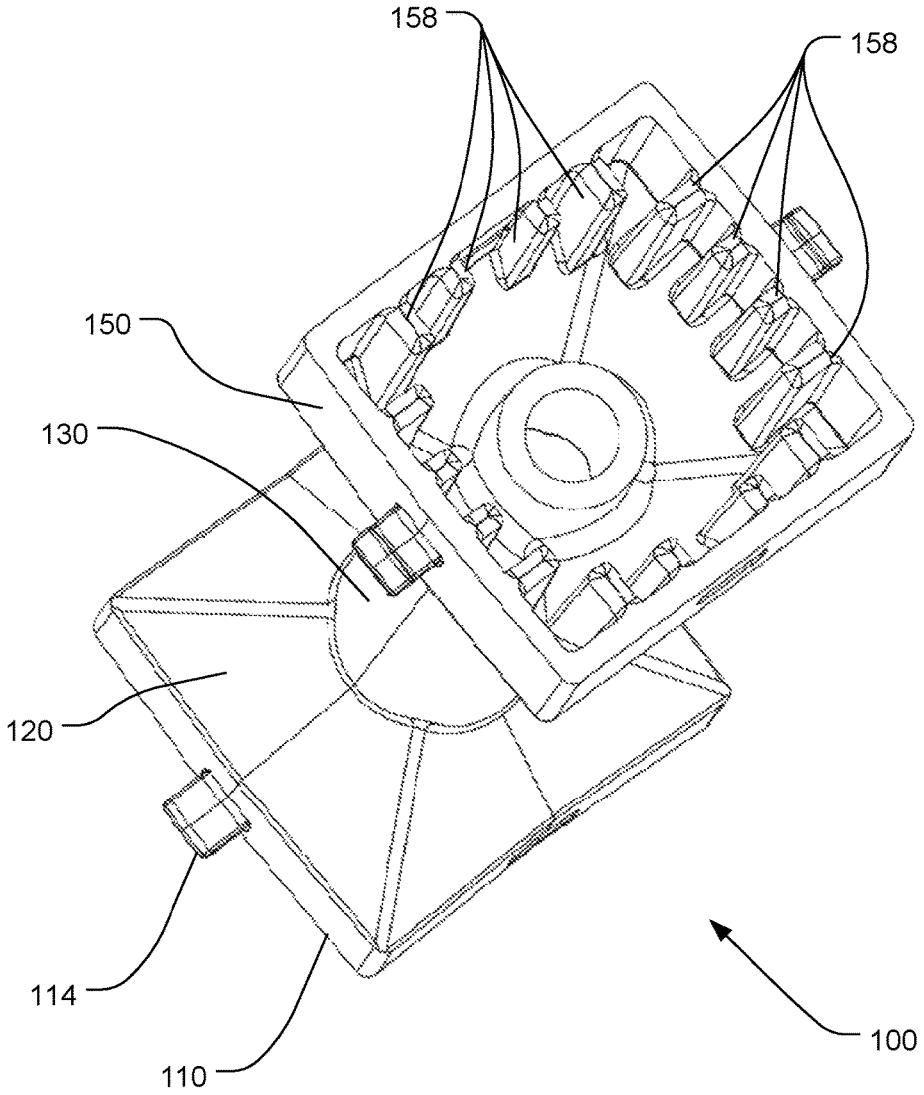
FIG. 13 illustrates a perspective bottom view of another alternate exemplary embodiment of a smoking paper chimney portion highlighting a plurality of base walls spacing ribs.

FIG. 13 illustrates a perspective bottom view of another alternate exemplary embodiment of a smoking paper chimney portion 100 highlighting a plurality of base walls spacing ribs 158. These ribs extend into the space inside the plurality of base walls 150 so as to engage the smaller diameter of the curved tip pusher 230 from FIG. 12. The ribs 158 ensure that the curved tip pusher 230 is properly aligned and centered in the chimney so that it can contact the bottom of the pre-rolled smoking paper and press upwards once the tip pusher 230 is fuller inserted into the chimney 100.

Figure 14A:
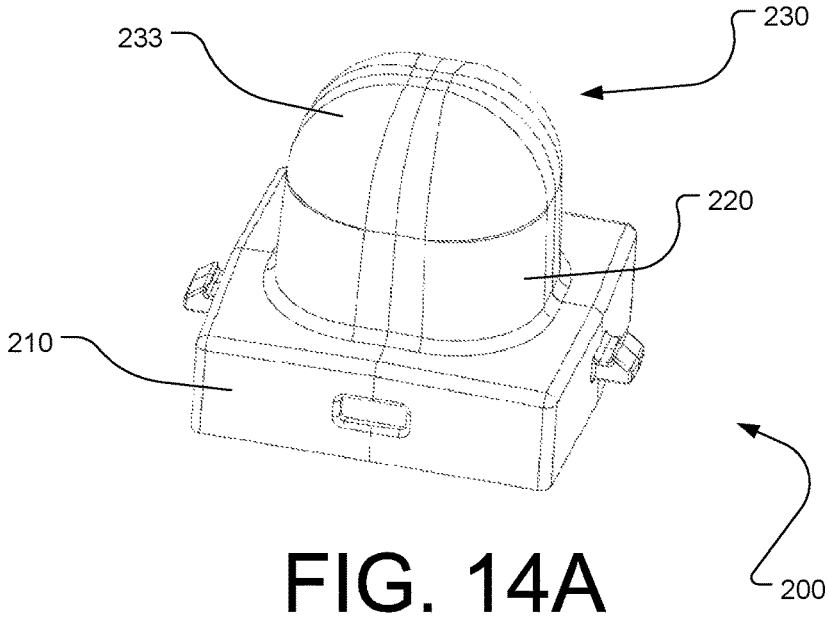
FIG. 14A illustrates a perspective view of another alternate exemplary embodiment of an extractor base portion without a short smoking paper tip pusher extension.
Figure 14B:
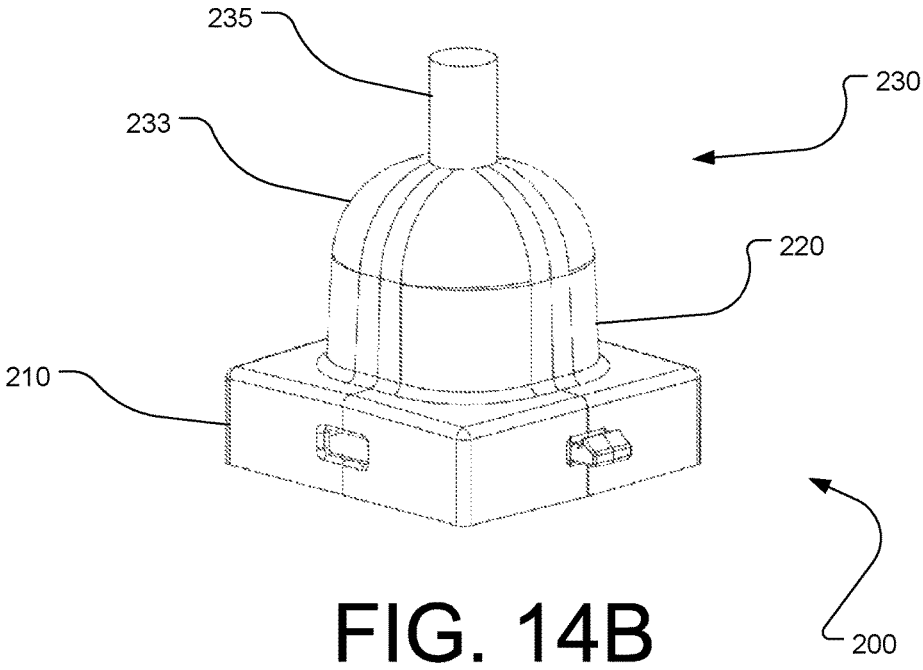
FIG. 14B illustrates a perspective view of another alternate exemplary embodiment of an extractor base portion with a short smoking paper tip pusher extension.

FIG. 14A illustrates a perspective view of another alternate exemplary embodiment of an extractor base portion 200 without a short smoking paper tip pusher extension 235 (see FIG. 14B). When using long smoking papers, no extra extension is necessary and this extractor base 200 is appropriate. Compare this to FIG. 14B below. However, the tip pusher extension 235 of FIG. 14B can be used with long papers, as discussed above.

FIG. 14B illustrates a perspective view of another alternate exemplary embodiment of an extractor base portion 200 with a short smoking paper tip pusher extension 235. The extra length provided by the extension 235 allows the tip pusher 230 to contact the short smoking paper tips and push the tops of the smoking papers upwards beyond the top of the chimney for ease-of-grasping by a person when the extractor base 200 is inserted into the chimney 100.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

What is claimed is:

1. A pre-rolled smoking paper stuffer, comprising:

a smoking paper chimney having a top end and a bottom end;

the top end of the smoking paper chimney comprising a separator wall bin having a plurality of separator walls in proximity with one another and an open space therebetween;

the separator wall bin attached to a converging guide, the converging guide positioned below the separator wall bin so that any materials placed in the open space of the separator wall bin will flow downwards via gravity into the converging guide;

the separator wall bin designed to receive materials therein and to contain them within the bin until the materials move into the converging guide;

the converging guide comprising a plurality of sloping sidewalls that converge in order to funnel materials downwards and out a bottom of the converging guide;

the converging guide positioned above a smoking paper cradle so that materials that flow out of the bottom of the converging guide flow into a top of the smoking paper cradle;

the smoking paper cradle having an inverted cone interior with the top of the smoking paper cradle having a larger top opening than a bottom opening at a bottom of the smoking paper cradle and an apex of the inverted cone interior being below the bottom opening of the smoking paper cradle;

the smoking paper cradle able to receive a pre-rolled smoking paper within the inverted cone interior;

below the bottom of the smoking paper cradle and attached to at least one of the smoking paper cradle, the converging guide, and the separator wall bin is a smoking paper tip spacer;

the smoking paper tip spacer positioned to raise the bottom of the smoking paper cradle up and keep the bottom of the smoking paper cradle from contacting a surface upon which the stuffer is standing;

a plurality of base walls attached to at least one of the smoking paper tip spacer, the smoking paper cradle, the converging guide, and the separator wall bin;

the plurality of base walls form a guide which receives an extractor base and aligns at least a portion of the extractor base below the bottom opening of the smoking paper cradle;

the extractor base comprises an extractor block, a pusher tip alignment block, and a tip pusher;

the extractor block forms a bottom of the extractor base and allows the extractor base to stand upright;

the pusher tip alignment block is attached to the extractor block and is received by the plurality of base walls in order to align the tip pusher with the bottom opening of the smoking paper cradle;

the aligned tip pusher positioned to contact a bottom of the pre-rolled smoking paper and displace the pre-rolled smoking paper upwards as the pusher tip alignment block is fully received by the plurality of base walls; and further comprising a plurality of attachment means, the plurality of attachment means provide for attachment of multiple stuffers to one another to form stuffer modules, the stuffer modules containing stuffers all standing approximately vertically and centered in approximately a single horizontal plane.

2. The pre-rolled smoking paper stuffer of claim 1, wherein the plurality of attachment means comprises at least an attachment port and an attachment prong, wherein the attachment prong from any first stuffer is designed to removably attach to the attachment port on any second stuffer; and wherein the attachment means is configured on at least one of the smoking paper cradle, the converging guide, and the separator wall bin.

3. The pre-rolled smoking paper stuffer of claim 2, wherein the plurality of attachment means further comprises:

a base attachment receiver and a base attachment clip, wherein the base attachment clip from any first stuffer is designed to removably attach to the base attachment receiver on any second stuffer; and wherein the base attachment receiver and the base attachment clip are configured on at least one of the smoking paper tip spacer, and the plurality of base walls.

4. The pre-rolled smoking paper stuffer of claim 3, wherein the plurality of attachment means further comprises:

an extractor clip and an extractor receiver, wherein the extractor clip from any first stuffer is designed to removably attach to the extractor receiver on any second stuffer; and wherein the extractor clip and the extractor receiver are configured on the extractor base.

5. The pre-rolled smoking paper stuffer of claim 1, wherein the plurality of attachment means comprises at least a base attachment receiver and a base attachment clip, wherein the base attachment clip from any first stuffer is designed to removably attach to the base attachment receiver on any second stuffer; and wherein the attachment means is configured on at least one of the smoking paper tip spacer, and the plurality of base walls.

6. The pre-rolled smoking paper stuffer of claim 1, wherein the plurality of attachment means comprises at least an extractor clip and an extractor receiver, wherein the extractor clip from any first stuffer is designed to removably attach to the extractor receiver on any second stuffer; and wherein the attachment means is configured on the extractor base.

7. A pre-rolled smoking paper stuffer, comprising:

a smoking paper chimney having a top end and a bottom end;

the top end of the smoking paper chimney comprising a separator wall bin having a plurality of separator walls in proximity with one another and an open space therebetween;

the separator wall bin attached to a converging guide, the converging guide positioned below the separator wall bin so that any materials placed in the open space of the separator wall bin will flow downwards via gravity into the converging guide;

the separator wall bin designed to receive materials therein and to contain them within the bin until the materials move into the converging guide;

the converging guide comprising a plurality of sloping sidewalls that converge in order to funnel materials downwards and out a bottom of the converging guide;

the converging guide positioned above a smoking paper cradle, wherein a top of the smoking paper cradle is attached to the bottom of the converging guide so that materials that flow out of the bottom of the converging guide flow into the top of the smoking paper cradle;

the smoking paper cradle having an inverted cone interior with the top of the smoking paper cradle having a larger top opening than a bottom opening at a bottom of the smoking paper cradle and an apex of the inverted cone interior being below the bottom opening of the smoking paper cradle;

the smoking paper cradle able to receive a pre-rolled smoking paper within the inverted cone interior;

attached to the smoking paper cradle and extending downwards therefrom is a smoking paper tip spacer;

the smoking paper tip spacer positioned to raise the bottom of the smoking paper cradle up and keep the bottom of the smoking paper cradle from contacting a surface upon which the stuffer is standing;

a plurality of base walls attached to at least one of the smoking paper tip spacer, the smoking paper cradle, the converging guide, and the separator wall bin;

the plurality of base walls form a guide which receives an extractor base and aligns at least a portion of the extractor base below the bottom opening of the smoking paper cradle;

the extractor base comprises an extractor block, a pusher tip alignment block, and a tip pusher;

the extractor block forms a bottom of the extractor base and allows the extractor base to stand upright;

the pusher tip alignment block is attached to the extractor block and is received by the plurality of base walls in order to align the tip pusher with the bottom opening of the smoking paper cradle;

the aligned tip pusher positioned to contact a bottom of the pre-rolled smoking paper and displace the pre-rolled smoking paper upwards as the pusher tip alignment block is fully received by the plurality of base walls; and further comprising a plurality of attachment means, the plurality of attachment means provide for attachment of multiple stuffers to one another to form stuffer modules, the stuffer modules containing stuffers all standing approximately vertically and centered in approximately a single horizontal plane.

8. The pre-rolled smoking paper stuffer of claim 7, wherein the plurality of attachment means comprises at least an attachment port and an attachment prong, wherein the attachment prong from any first stuffer is designed to removably attach to the attachment port on any second stuffer; and wherein the attachment means is configured on at least one of the smoking paper cradle, the converging guide, and the separator wall bin.

9. The pre-rolled smoking paper stuffer of claim 8, wherein the plurality of attachment means further comprises:

a base attachment receiver and a base attachment clip, wherein the base attachment clip from any first stuffer is designed to removably attach to the base attachment receiver on any second stuffer; and wherein the base attachment receiver and the base attachment clip are configured on at least one of the smoking paper tip spacer, and the plurality of base walls.

10. The pre-rolled smoking paper stuffer of claim 9, wherein the plurality of attachment means further comprises:

an extractor clip and an extractor receiver, wherein the extractor clip from any first stuffer is designed to removably attach to the extractor receiver on any second stuffer; and wherein the extractor clip and the extractor receiver are configured on the extractor base.

11. A pre-rolled smoking paper stuffer, comprising:

a smoking paper chimney having a top end and a bottom end and extending longitudinally therebetween;

the top end of the smoking paper chimney comprising a separator wall bin having a plurality of separator walls in proximity with one another and an open space therebetween;

the separator wall bin attached to a converging guide, the converging guide positioned below the separator wall bin so that any materials placed in the open space of the separator wall bin will flow downwards via gravity into the converging guide;

the separator wall bin designed to receive materials therein and to contain them within the bin until the materials move into the converging guide;

the converging guide comprising a plurality of sloping sidewalls that converge in order to funnel materials downwards and out a bottom of the converging guide;

the converging guide positioned above a smoking paper cradle, wherein a top of the smoking paper cradle is attached to the bottom of the converging guide so that materials that flow out of the bottom of the converging guide flow into the top of the smoking paper cradle;

the smoking paper cradle having an inverted cone interior with the top of the smoking paper cradle having a larger top opening than a bottom opening at a bottom of the smoking paper cradle and an apex of the inverted cone interior being below the bottom opening of the smoking paper cradle;

the smoking paper cradle able to receive a pre-rolled smoking paper within the inverted cone interior;

attached to the smoking paper cradle and extending downwards therefrom is a smoking paper tip spacer;

the smoking paper tip spacer positioned to raise the bottom of the smoking paper cradle up and keep the bottom of the smoking paper cradle from contacting a surface upon which the stuffer is standing;

a plurality of base walls attached to the smoking paper tip spacer and forming a guide which receives an extractor base and aligns at least a portion of the extractor base below the bottom opening of the smoking paper cradle;

the extractor base comprises an extractor block, a pusher tip alignment block, and a tip pusher;

the extractor block forms a bottom of the extractor base and allows the extractor base to stand upright;

the pusher tip alignment block is attached to the extractor block and is received by the plurality of base walls;

a plurality of base wall spacing ribs extending from an interior of the plurality of base walls and positioned to engage with the alignment block in order to align the tip pusher with the bottom opening of the smoking paper cradle;

the tip pusher having a short smoking paper tip pusher extension extending upwards from the tip pusher and positioned to contact a bottom of the pre-rolled smoking paper and displace the pre-rolled smoking paper upwards as the pusher tip alignment block is fully received by the plurality of base walls; and further comprising a plurality of attachment means, the plurality of attachment means provide for attachment of multiple stuffers to one another to form stuffer modules, the stuffer modules containing stuffers all standing approximately vertically and centered in approximately a single horizontal plane.

12. The pre-rolled smoking paper stuffer of claim 11, wherein the plurality of attachment means comprises at least an attachment port and an attachment prong, wherein the attachment prong from any first stuffer is designed to removably attach to the attachment port on any second stuffer; and wherein the attachment means is configured on at least one of the smoking paper cradle, the converging guide, and the separator wall bin.

13. The pre-rolled smoking paper stuffer of claim 12, wherein the plurality of attachment means further comprises:

a base attachment receiver and a base attachment clip, wherein the base attachment clip from any first stuffer is designed to removably attach to the base attachment receiver on any second stuffer; and wherein the base attachment receiver and the base attachment clip are configured on at least one of the smoking paper tip spacer, and the plurality of base walls.

14. The pre-rolled smoking paper stuffer of claim 13, wherein the plurality of attachment means further comprises:

an extractor clip and an extractor receiver, wherein the extractor clip from any first stuffer is designed to removably attach to the extractor receiver on any second stuffer; and wherein the extractor clip and the extractor receiver are configured on the extractor base.

* * * * *